United States Patent [19]

Mally

[11] Patent Number: 4,529,082

[45] Date of Patent: Jul. 16, 1985

[54] STACK FORMING METHOD AND APPARATUS

[75] Inventor: Timothy G. Mally, Oregon, Wis.

[73] Assignee: Oscar Mayer Foods Corporation, Madison, Wis.

[21] Appl. No.: 578,991

[22] Filed: Feb. 13, 1984

Related U.S. Application Data

[63] Continuation of Ser. No. 306,418, Sep. 28, 1981, abandoned.

[51] Int. Cl.[3] ..... B65G 47/26

[52] U.S. Cl. ..... 198/434; 198/461; 198/627

[58] Field of Search ..... 198/434, 459, 461, 462, 198/422, 627, 653, 654; 271/233, 269, 271, 240, 238, 216; 414/28

[56] References Cited

U.S. PATENT DOCUMENTS

| | | | |
|---|---|---|---|
| 2,805,757 | 9/1957 | Rapley | 198/422 X |
| 3,061,303 | 10/1962 | Claser et al. | 271/240 X |
| 3,348,655 | 10/1967 | Pierce, Jr. et al. | 198/461 |
| 3,382,965 | 5/1968 | Pierce, Jr. et al. | 198/461 |
| 3,638,538 | 2/1971 | Sullivan | 198/422 |
| 3,964,598 | 6/1976 | Alsop | 271/216 X |
| 4,015,843 | 4/1977 | Tennant | 271/240 |

*Primary Examiner*—Joseph E. Valenza
*Assistant Examiner*—Dennis Williamson
*Attorney, Agent, or Firm*—Joseph T. Harcarik; Thomas R. Savoie; Daniel J. Donovan

[57] ABSTRACT

A method and apparatus are disclosed for forming a substantially aligned and uniform stack of flat articles (for example, food products such as sliced sausage products) from a non-uniform stack. The first stack is positioned between at least a pair of stack engaging members which are movable in the same direction, but at different speeds, to converge gradually and engage the articles, thereby moving the articles into a substantially aligned and uniform stack.

19 Claims, 7 Drawing Figures

STACK FORMING METHOD AND APPARATUS

This application is a continuation of application Ser. No. 306,418, filed Sept. 28, 1981, now abandoned.

The present invention relates, in general, to a method and apparatus for forming stacks of flat articles. More particularly, this invention relates to a method and apparatus for forming a substantially aligned and uniform stack of flat articles.

Although suitable for use with various flat articles, the present invention is particularly suitable for use in forming a substantially aligned and uniform stack of sliced food products such as sliced sausage products (bologna, salami, summer sausage, etc.). These flat articles can be of different shapes—such as round, square and rectangular.

For purposes of illustrating a specific embodiment, this invention will be described with reference to use with sliced sausage products.

In the production of sliced sausage products, a typical procedure is to cut the slices from a long sausage or loaf by a high speed rotary slicer which discharges the slices in non-uniform stacks of the desired quantity and weight. Before the stacks can be inserted into the snug-fitting cavities of preformed packages, the slices must be arranged into a substantial alignment; otherwise, overlapping or overhanging slices would impair insertion of the stacks into the packages. In addition, a uniform, vertically aligned stack, which typically is visible through a clear package, is more appealing and indicates to the consumer a greater attention to product quality.

Previously, arranging the slices into substantial vertical alignment has been accomplished by manual handling. Although this has resulted in a satisfactory finished product, the industry desires to automate such operations for the purposes of reducing cost, increasing production speed and improving product uniformity and quality control.

Accordingly, an object of the present invention is to provide a method and apparatus for forming a substantially aligned and uniform stack of flat articles from a non-uniform stack.

Another object of the present invention is to provide such method and apparatus for use with sliced sausage products such as luncheon meat, salami, bologna and the like.

These and other objects will become apparent from the following detailed description of this invention.

In accordance with the present invention, the stack forming and aligning operation may be carried out by positioning the non-uniform stack between at least a pair of stack engaging members which are movable in the same direction but at different speeds to close in upon or converge against the opposite sides of the stack, moving the slices into vertical alignment as the stack moves downstream from the slicer. Preferably, the stack engaging members are moved intermittently with the repeated stopping and starting helping to move the slices into vertical alignment. Although the stack may be moved by the stack engaging members, the stack is preferably carried on an underlying conveyor which moves continuously in the same direction as the stack engaging members but at a greater speed to continuously urge the stack against the forwardmost of the stack engaging members. In addition, converging side rails may be provided along the path of movement of the stack to force any side overhanging articles into alignment.

In accordance with a further aspect of the present invention, at the point where the stack engaging members have converged to the desired stack width, the side rails are spaced apart a distance slightly less than the width of the stack to provide a lateral force against the stack. This lateral force, together with a simultaneous downward containment applied to the stack by other apparatus, further aids in causing the articles to come into vertical alignment.

These and other aspects of the present invention are set forth in the following detailed description of the preferred embodiment shown in the attached drawings, of which:

Figure 5:
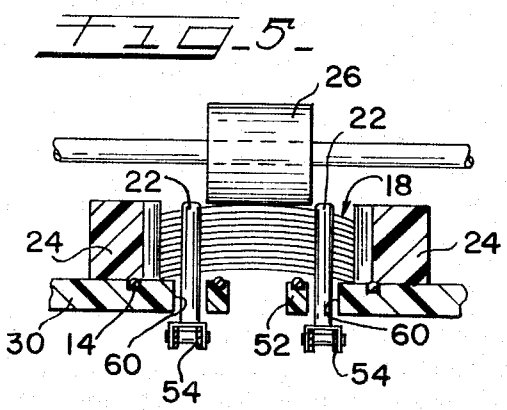
FIG. 5 is a vertical sectional view taken along line 5—5 of FIG. 4.
Figure 5A:
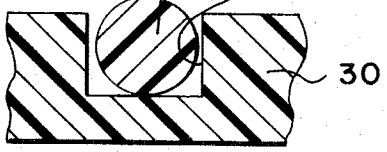

FIG. 5*a* is an enlarged view of a portion of FIG. 5, depicting one of the underlying stack conveyors and the slot in the dead plate within which the conveyor moves.

Figure 1:
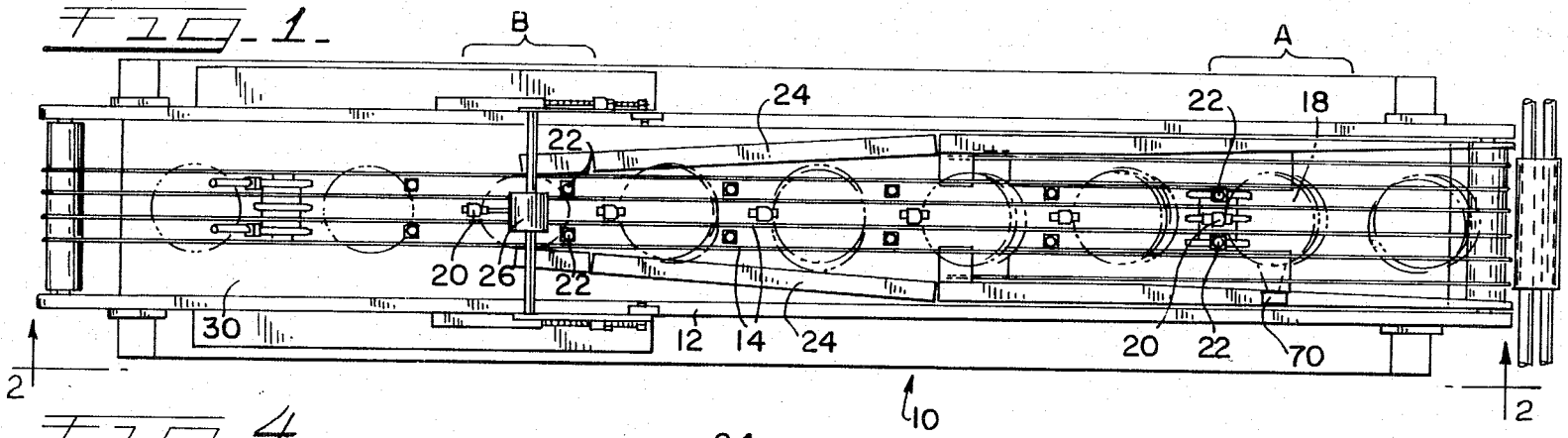
FIG. 1 is a top plan view of apparatus embodying the present invention for forming substantially vertical and uniform stacks of sliced meat products.
Figure 6:
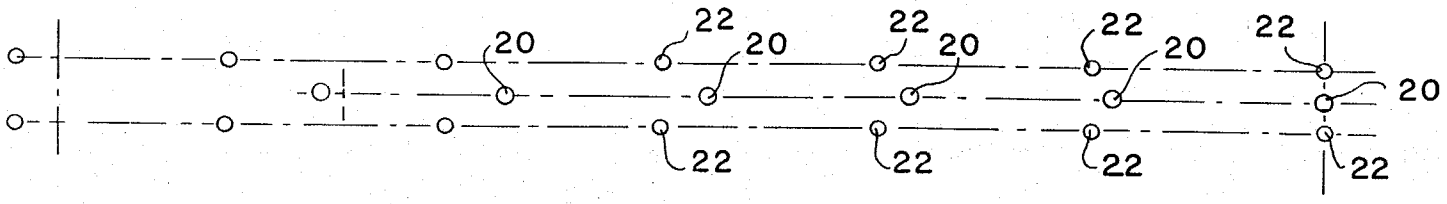

FIG. 6 is a diagrammatic view of the movement of the stack engaging pins as they proceed from right to left on the conveyor apparatus of FIG. 1.

The present invention, in summary, is generally embodied in conveyor apparatus 10 having an elongated support frame 12 which mounts a plurality of endless conveyor belts or bands 14 that are driven by motor means 16 for moving stacks 18 of sliced sausage, luncheon meat and the like. The stacks 18 are received onto the conveyor belts 14 at the right hand end of the apparatus shown in FIGS. 1 and 2 in a non-uniform condition resulting from an upstream slicing and/or weighing operation (not shown).

In accordance with the present invention, the slices of stacks 18 are gently moved into substantial vertical alignment as the stacks move along the conveyor apparatus 10 by first and second, leading and following, stack engaging members in the form of upstanding pins 20 and 22. These pins are movable from an upstream position (generally designated A in FIG. 1), where they are spaced apart sufficiently to receive a non-uniform stack, to a downstream position (generally designated B in FIG. 1), where they have gradually converged by reason of the faster drive speed of the pins 22. The faster drive speed enables the pins 20 and 22 to engage the front and rear edges of the slices and move the slices into substantial vertical alignment to provide a uniform stack. The pins 20 and 22 are preferably driven intermittently, each set of pins stopping adjacent to the position A for receiving a non-uniform stack of slices.

At relatively high production speeds, the vibration from this fast stopping and starting of the pins aids in forming the slice into a substantially uniform, vertically aligned stack. As a further aid in the formation of the slices into vertical alignment, a pair of converging side rails 24 are mounted on opposite sides of the conveyor belts 14 to engage side edges of the slices and gently move them into vertical aignment.

Figure 4:
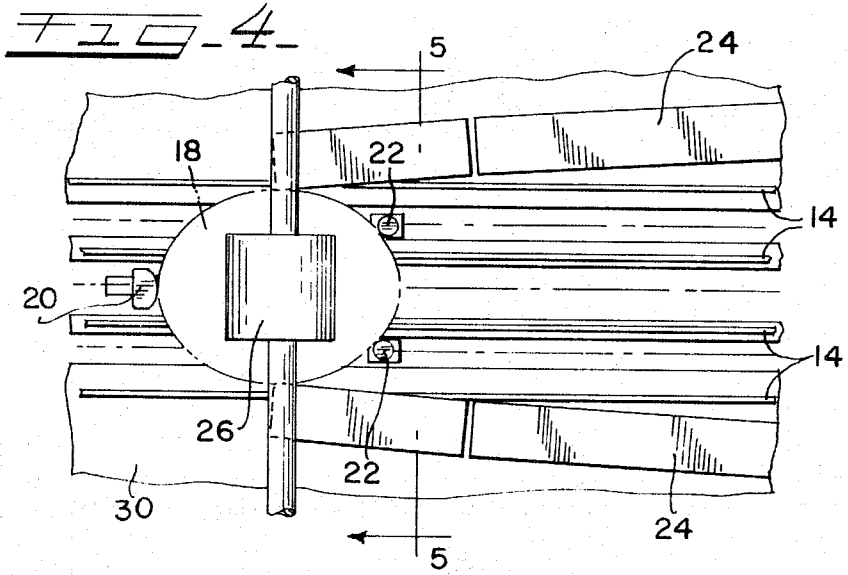
FIG. 4 is an enlarged, fragmentary top plan view taken on line 4—4 of FIG. 2 and depicting the location at which the substantially vertical and uniform stack is formed.

At the position B, where the pins 20 and 22 have come together or converged to the desired spacing for a uniform stack, the rails 24 preferably are spaced apart slightly less than the final preferred width of a uniform stack. This spacing causes a compression of the stack (best seen in FIGS. 4 and 5) which, together with a downward containment force from roller 26 mounted above the stack, further contributes to the formation of a substantially vertically aligned stack.

Figure 2:
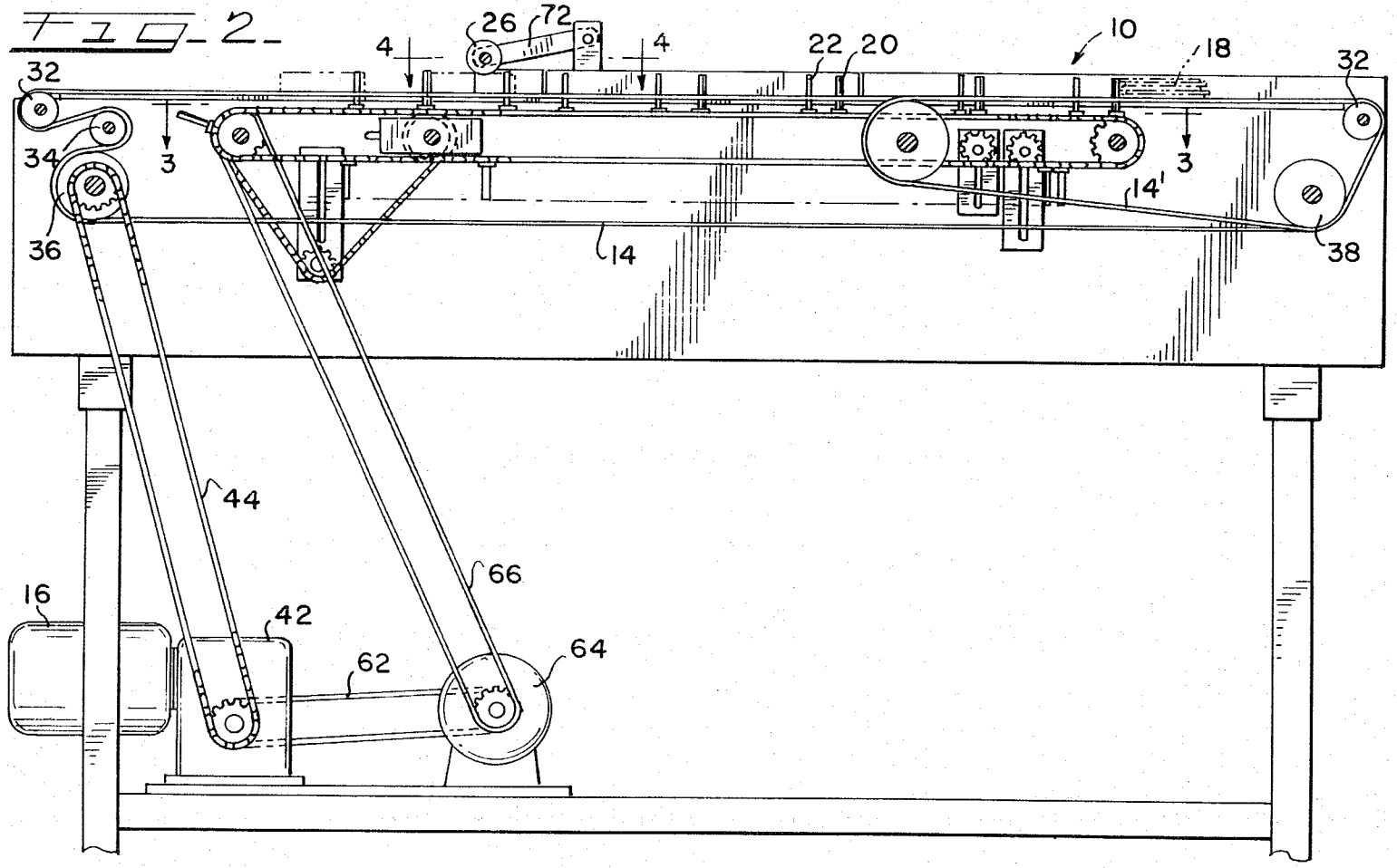
FIG. 2 is a side elevational view taken on line 2—2 of FIG. 1.

Turning now to a more detailed description, the conveyor apparatus 10 as a whole is perhaps best seen in FIGS. 1 and 2. The support frame 12 of the conveyor apparatus may be of any desired length sufficient to convey the stacks from the upline slicing and/or weighing equipment (not shown) to downstream apparatus or work stations for further packaging. Atop the conveyor support frame is mounted a dead plate 30 which, for sanitary purposes associated with food handling, is preferably made of high density polyethylene or similar material which is easy to clean and also has a relatively low coefficient of friction.

The stacks of slices are moved from the right end of the conveyor apparatus 10 to the left by the endless conveyor belts 14 which (referring to FIG. 2) extend between end rollers 32 and around idler roller 34 and drive rollers 26 and 38. For the purposes of this description, the term "non-uniform" refers to a stack in which the slices are not in sufficient vertical alignment for subsequent insertion into snug-fitting cavities or preformed packages. However, for the present invention, the slices of a non-uniform stack must be at least in partial overlapping relationship with respect to one another.

As best seen in FIGS. 5 and 5*a*, the conveyor belts 14 which carry the stacks 18 are preferably of generally circular cross-section and move in longitudinal slots 40 in the top surface of the dead plate 30. However, the conveyor belts 14 may also have a flat configuration. Although a variety of materials may be used, the conveyor belts 14 preferably are made of polyurethane.

Referring back to FIG. 2, the conveyor belts 14 are driven at a continuous selected speed (which is faster than that of either of the pins 20 or 22) by motor means 16, via gear box 42 and drive chain 44. At the upstream end of the conveyor apparatus, an additional pair of outside conveyor belts 14' is provided for increasing the width of the conveyor surface in that area where the belts 14 receive the articles from the slicing and/or weighing operation. These additional belts may or may not be necessary, depending on the degree of overlap of the slices when received from the upstream operation.

The slices of the non-uniform stacks 18 are moved into substantial vertical alignment by pins 20 and 22 which move in the same direction as the conveyor belts but at different respective speeds to gradually move closer together or converge as they move along the conveyor apparatus.

Describing this arrangement now in more detail, and referring to FIGS. 3, 5 and 6, the leading pins 20 are equally spaced on a centrally located continuous chain 46 which extends between end sprockets 49 and 50 and is positioned below the dead plate 30. The pins 20 extend upwardly through a center slot 52 in the dead plate so as to engage the stack 18, and are spaced sufficiently far apart that a non-uniform stack may be received between adjacent pins.

The center chain 46 which carries the upright pins 20 is flanked by a pair of chains 54 which carry aligned following pins 22 in an equally spaced relationship. The chains 54 extend between upstream end sprockets 56 which are mounted on the same shaft 57 as upstream end sprocket 48 of the center chain 46, and downstream end sprockets 59 which are spaced beyond end sprocket 50 of the center chain. As with the center chain, the side chains 54 run beneath the dead plate 30, and the pins 22 extend upwardly through slots 60 in the dead plate.

Figure 3:
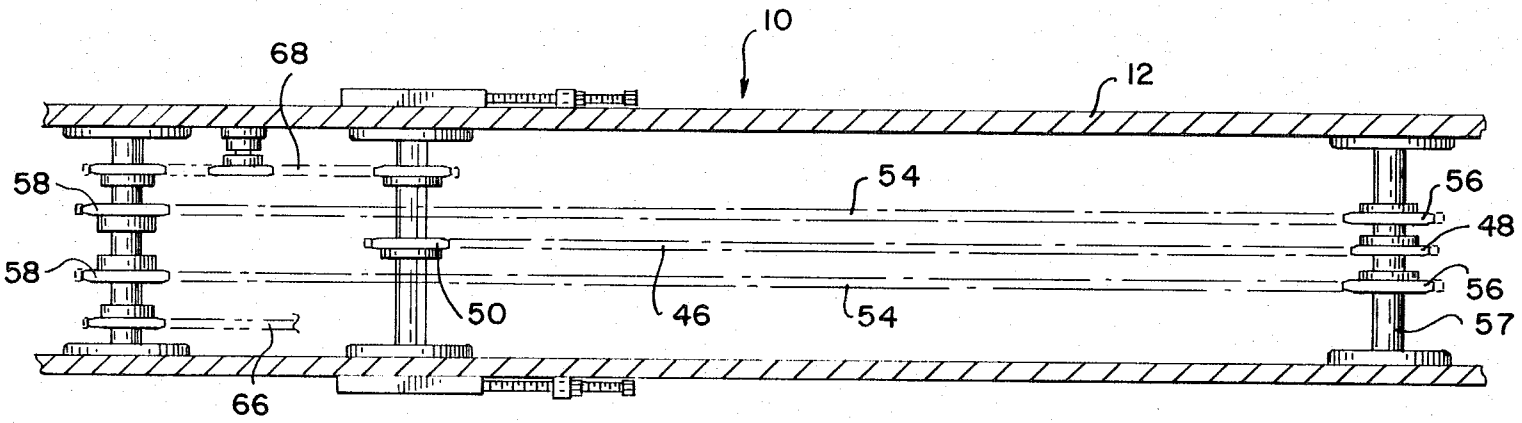
FIG. 3 is a horizontal sectional view taken along line 3—3 of FIG. 2.

As best seen in FIGS. 2, 3 and 6, the pins 22 of the chains 54 are aligned in a side-by-side relationship, and the pins 22 of each chain 54 are spaced apart a selected distance greater than the distance between the pins 20 of the center chain 46. This relative spacing, commonly referred to as the "pitch" of the pins, together with the higher drive speed for pins 22, creates the gradual converging of the pins 20 and 22 between the spaced-apart receiving position A and the converged stack-formed position B.

The chains 46 and 54 are driven by the motor means 16 which is connected via drive belt 62 and clutch 64 to drive chain 66 (FIG. 2). The drive chain 66 directly drives the downstream end sprocket 59 of the longer chains 54 and, via intermediate drive chain 68, indirectly turns the downstream sprocket 50 of the center chain 46. Accordingly, all three chains are driven (either directly or indirectly) by the motor 16, via clutch 64.

As noted briefly above in reference to FIGS. 1 and 3, the pins 22 on the outer chains 54 are positioned side-by-side in pairs, and each pair is spaced from adjacent pairs on the chains 54 by a distance which is greater than the space between adjacent pins 20 on the center chain 46. Or in other words, the pitch of the following pins 22 on the outer chains is greater than the pitch of leading pins 20 on the center chain. The outside chains 54 which carry the pins 22 are driven at a faster speed than the center chain, so that each side-by-side pair of pins 22 moves closer to or converges with the next downstream center pin 20 to form the non-uniform stacks into substantially uniform stacks having slices substantially aligned. The different speeds are achieved by employing different size drive sprockets for the conveyor chains.

In the preferred embodiment, the sprockets 56 and 58 for the outside chains 54 are larger than the end sprockets 48 and 50 for center chain 46. The sprockets for both chains are rotated at the same RPM and, accordingly, the outside chains move faster. The relative difference in speeds of the chains is such that the following outside pins 22 can converge toward a leading center pin 20, reaching a position where the distance between the outside pins and the center pin is the desired width or diameter of the aligned stack by the time the pins reach position B. The lengths of the chains 46 and 54 are chosen with respect to the spacing between the pins so that one pair of the pins 22 returns to the upstream sprockets 48 and 56 at the same time as one of the center pins 20 returns (See FIGS. 1 and 6). Then as the pins move along the top side of the conveyor apparatus from position A to position B, the outside pins 22 gradually progress toward the next most downstream center pin 20. This relative movement is illustrated diagrammatically in FIG. 6 for one pair of following pins 22 and leading pins 20.

The clutch 64 which controls movement of the chains 46 and 54 is associated with an electric eye or other detection means for detecting the presence of a stack 18 at the position shown in FIG. 2. Upon detecting the presence of a stack, the electric eye energizes the clutch to drive the chains one incremental distance forward, until the next set of pins 20 and 22 are positioned above the upstream end sprockets 48 and 56. While the pins 20 and 22 are moving intermittently, the conveyor belts 14 are continuously moving, urging the stacks against the center pins 20. Because the conveyor belts are circular in shape and have only a small area of contact with the stack, they slide freely beneath the stacks when further stack movement is prevented by abutment with the pin 20. The repeated starting and stopping of the intermittent motion at production speeds vibrates the slices of the stack, aiding in the formation of the slices into vertical alignment by the pins 20 and 22. The slices 18 are preferably cut from a frozen sausage or loaf, so that they slide against one another more easily than thawed slices.

As a further aid in forming the stacks 18, side rails 24 are mounted on opposite sides of the conveyor support frame 12 to help force any slices which are laterally out of line into vertical alignment. These side rails, as with the dead plate 30, are preferably made of high density polyethylene for sanitary purposes as well as low friction. The side rails preferably extend along substantially the entire length of the conveyor and gradually converge to the location B, at which the pins 20 and 22 are at the selected desired spacing for a vertically aligned stack of slices. At that position, the inside end edges of the side rails 24 are spaced apart a distance slightly less than the normal width of a vertically aligned stack. This results in a lateral compression of the stack with resultant bowing of the slices, as illustrated in FIG. 5. This action has been found to help form the slices of the stack into a vertical, uniform arrangement. This compression and the immediate release from the compression as the stack moves past the end edges of the side rails are believed to result in a shuffling and slight lifting of the stack which overcomes frictional resistance between adjacent slices and aids in aligning one slice atop the other. Position B, where the pins 20 and 22 are spaced the selected final width of the stack, and where the side rails are spaced apart slightly less than the final width of the stack, is located immediately upstream of the point where the leading pin 20 begins to move around the end sprocket 50.

In combination with the lateral compression by side rails 24, a downward containment force is applied to the stack at position B by roller 26 which is mounted at the end of freely rotatably pivot arm 72 (see FIG. 2) so as to ride over the top of the stack 18 as the stack is being laterally compressed by the side rails. Although the weight of the roller is sufficient to aid in forming the uniform stack, the roller also could be spring biased or otherwise caused to exert downward force on the stack.

The operation of this stack forming apparatus and method is perhaps best understood by reference back to FIGS. 1 and 6. The slices which make up each stack 18 are preferably frozen, having been cut by the slicer from a frozen loaf or sausage. The frozen condition not only permits more uniform slicing but, for the purposes of the present invention, permits the slices to slide relatively easily with respect to one another, making alignment of the slices easier.

When the apparatus 10 is in operation, there is a stack 18 (illustrated in dashed lines in FIG. 1) position between each set of adjacent stack engaging pins 20 and 22 which are located along the conveyor surface. Before a new stack arrives, the pins 20 and 22 and in a static condition. At the upline or upstream end A, the pins 20 and 22 are generally aligned side-by-side awaiting the delivery of a new stack 18 from the slicing or weighing operation. Along the conveyor, stacks which arrived earlier are spaced between adjacent sets of leading and following pins 20 and 22. The farther along the conveyor that the stack is located, the closer each aligned pair of following pins 22 is located to the respective downstream leading pin 20, as the pins 22 gradually converge to position B where they are spaced apart the desired width of the finished vertical stack.

As a new stack is moved by the conveyor belts 14 up to and against the most upstream pin 22, which is positioned directly above sprocket 48, the stack trips the electric eye or other detecting means 70, which energizes the clutch 64, causing the motor means 16 to drive the chains 46 and 54 one increment forward, until a new set of pins 20 and 22 come around the upstream end sprockets. The clutch then disengages and the conveyor chains are static until another stack is moved into position from the slicer or weigher by the conveyor belts 14. Although the conveyor belts 14 are continuously driven, the stacks cannot move beyond the center leading pins 20, and the conveyor belts 14 slide beneath the stack. The circular cross-sectional shape of the polyurethane belts 14 and the resulting low frictional contact between the belts and the stacks minimize any harm to the meat. As the stacks move from right to left, any sidewardly displaced slices within the stack engage the side rails 24 which force the slices into a vertically aligned position within the stack.

For the stack 18 which is located at the position B, when conveyor chains move an increment forward, the leading pin 20 which is positioned in front of the stack moves immediately around its end sprocket 50, releasing the stack for forward movement by the underlying conveyor belts 14, which are continuously moving at a speed faster than either the pins 20 or 22. With the front pin 20 released, the conveyor belts 14 carry the formed vertical stack away from the rearward pins 22, so that when those pins move around their respective end sprockets 58, they do not catch or tear the rear edges of the stack. Although the stack may be caused by this action to bump into the next most downstream pair of following pins 22, this is not sufficient to disrupt or disarrange the stack alignment.

In forming uniform stacks of bologna having a slice diameter of $4\frac{1}{4}$ inches, the pins 20 are spaced 9 inches apart, and the pins 22 are spaced 8 inches apart. The drive sprockets 56 and 58 for chains 54 which carry the pins 22 have 18 teeth as compared to 16 teeth for the drive sprockets 48 and 50 of the center chain 46. Accordingly, the pins 22 move 9/8 or 1.125 times faster than pins 20. The length of the chains 46 and 54 is such to permit the pins 20 and 22 to converge to a $4\frac{1}{4}$ inch spacing at position B and to provide during the return cycle beneath the conveyor that the pins will regain the in-phase, in-line relationship at the upstream end of the chains. To further aid in the formation of an aligned stack, the side rails 24 converge to a spacing of $4\frac{1}{8}$ inches at position B to cause a slight compression of the stack 18, while a downward containment force is exerted by the weight of the polyethylene roller 26.

Although described in terms of a preferred embodiment, this invention can be embodied in various forms and, therefore, is to be construed and limited only the the scope of the appended claims.

I claim:

1. An apparatus for forming a substantially aligned and uniform stack of flat articles which are in at least partial overlapping relationship from a non-uniform stack, the apparatus comprising:

an elongated support structure;

first and second longitudinally movable stack engaging means carried by the support structure;

means for moving the first and second stack engaging means in the same direction along the support structure between a receiving position, wherein the first and second stack engaging means are spaced apart sufficiently to receive a non-uniform stack, and a stack-formed position spaced from the receiving position;

the moving means being adapted to move the first and second stack engaging means at sufficiently different speeds that the stack engaging means converge to engage and form the articles into substantial vertical alignment as the stack and the stack engaging means move toward the stack-formed position; and conveyor means having a generally horizontal upper article conveying run upon which the non-uniform stacks may be received, the conveyor means being carried by the support structure and being movable longitudinally in the same direction as the first and second stack engaging means, and the conveyor means being for moving the articles at a speed greater than the speed of either of the first and second stack engaging means and for urging the articles up to and against the forwardmost stack engaging means.

2. An apparatus in accordance with claim 1, further including side engaging means carried by the support structure and positioned to engage opposite sides of the stack to aid in forming the uniform stack as the stack and the stack engaging means move toward the stack-formed position.

3. An apparatus for forming a substantially aligned and uniform stack of flat articles which are in at least partial overlapping relationship from a non-uniform stack, the apparatus comprising:

an elongated support structure;

first and second longitudinally movable stack engaging means carried by the support structure;

means for moving the first and second stack engaging means in the same direction along the support structure between a receiving position, wherein the first and second stack engaging means are spaced apart sufficiently to receive a non-uniform stack, and a stack-formed position spaced from the receiving position;

the moving means being adapted to move the first and second stack engaging means at sufficiently different speeds that the stack engaging means converge to engage and form the articles into substantial vertical alignment as the stack and the stack engaging means move toward the stack-formed position;

conveyor means for moving the stack at a speed greater than the forwardmost stack engaging means and for urging the stack up to and against the forwardmost stack engaging means;

side engaging means carried by the support structure and positioned to engage opposite sides of the stack to aid in forming the uniform stack as the stack and the stack engaging means move toward the stack-formed position; and the side engaging means includes at least a pair of side rails which converge in the direction of movement of the stack and, at a selected position, are spaced apart a distance less than the width of the uniform stack.

4. An apparatus for forming a substantially aligned and uniform stack of flat articles which are in at least partial overlapping relationship from a non-uniform stack, the apparatus comprising:

an elongated support structure;

first and second longitudinally movable stack engaging means carried by the support structure;

means for moving the first and second stack engaging means in the same direction along the support structure between a receiving position, wherein the first and second stack engaging means are spaced apart sufficiently to receive a non-uniform stack, and a stack-formed position spaced from the receiving position;

the moving means being adapted to move the first and second stack engaging means at sufficiently different speeds that the stack engaging means converge to engage and form the articles into substantial vertical alignment as the stack and the stack engaging means move toward the stack-formed position;

side engaging means carried by the support structure and positioned to engage opposite sides of the stack to aid in forming the uniform stack as the stack and the stack engaging means move toward the stack-formed position;

the side engaging means includes at least a pair of side rails which converge in the direction of movement of the stack and, at a selected position, are spaced apart a distance less than the width of the uniform stack; and means to exert a downward containment force against the top of a stack at the selected position where the side engaging rails are spaced apart less than the width of the uniform stack.

5. An apparatus in accordance with claim 1, further including a plurality of equally spaced first stack engaging means and a plurality of equally spaced second stack enagaging means alternately located along the support structure to receive rough stacks between adjacent ones of the first and second stack engaging means, the distance between adjacent ones of the second stack engaging means being greater than the distance between adjacent ones of the first stack engaging means, the moving means moving the second stack engaging means faster than the first stack engaging means.

6. An apparatus in accordance with claim 1, wherein the moving means moves the first and second stack engaging means in an intermittent motion, stopping the first and second stack engaging means adjacent the receiving position for receiving a stack of articles between each adjacent pair of the first and second stack engaging means.

7. An apparatus in accordance with claim 1, wherein the flat articles are sliced food products.

8. An apparatus for forming a substantially aligned and uniform stack of sausage slices which are in at least partial overlapping relationship, the apparatus comprising:

elongated support means;

a line of equally spaced first stack engaging members carried by the support means;

a line of equally spaced second stack engaging members carried by the support means and adjacent and parallel to the line of first stack engaging members, the space between adjacent second stack engaging members being greater than the space between adjacent first stack engaging members, and the first and second stack engaging members being generally alternately located along the support means;

means for driving the first and second stack engaging members in the same direction between a receiving position, where adjacent of the first and second stack engaging members are spaced apart sufficiently to receive a non-uniform stack, and a stack-formed position spaced from the receiving position;

the driving means being adapted to drive the first and second stack engaging members at sufficiently different speeds that each of the adjacent first and second stack engaging members converge to engage and form the slices into substantial vertical alignment as the stack engaging members move toward the stack-formed position; and conveyor means carried by the support means and parallel to the lines of first and second stack engaging members, the conveyor means being positioned to underlie and receive stacks deposited at the receiving position, and means for driving the conveyor means in the same direction and faster than the first and second stack engaging member, said driving means also being for urging the stacks up to and against the forwardmost stack engaging member.

9. An apparatus for forming a substantially aligned and uniform stack of sausage slices which are in at least partial overlapping relationship, the apparatus comprising:

elongated support means;

a line of equally spaced first stack engaging members carried by the support means;

a line of equally spaced second stack engaging members carried by the support means and adjacent and parallel to the line of first stack engaging members, the space between adjacent second stack engaging members being greater than the space between adjacent first stack engaging members, and the first and second stack engaging members being generally alternately located along the support means;

means for driving the first and second stack engaging members in the same direction between a receiving position, where adjacent of the first and second stack engaging members are spaced apart sufficiently to receive a non-uniform stack and a stack-formed position spaced from the receiving position;

the driving means being adapted to drive the first and second stack engaging members at sufficiently different speeds that each of the adjacent first and second stack engaging members converge to engage and form the slices into substantial vertical alignment as the stack engaging members move toward the stack-formed position; and means to downwardly engage the top of a stack as the stack moves to the stack-formed position.

10. An apparatus in accordance with claim 8, wherein the driving means drives the first and second stack engaging members in an intermittent motion, stopping adjacent first and second stack engaging members at the receiving position to receive a stack.

11. An apparatus for forming a substantially aligned and uniform stack of sausage slices which are in at least partial overlapping relationship, the apparatus comprising:

conveyor means carried by the support means and movable at a continuous selected speed for transporting stacks of sausage slices between a receiving position, where stacks are deposited onto the conveyor means, and a stack-formed position spaced from the receiving position;

a plurality of first and second stack engaging members spaced alternately along the conveyor means and movable parallel to the conveyor means, each pair of adjacent first and second stack engaging members defining a stack engaging set, the first stack engaging member of each set being disposed to engage a forward side portion of a stack moving along the conveyor means, and the second stack engaging member of each set being disposed to engage a rearward side portion of the same stack;

means for moving the first and second stack engaging members in the same direction as the conveyor means between the receiving position and the stack-formed position, the first stack engaging members being equally spaced along the conveyor means and the second stack engaging members being equally spaced along the conveyor means by a distance greater than the first stack engaging members, the moving means being adapted to move the second stack engaging members at a faster speed than the first stack engaging members such that the first and second members of each set are spaced sufficiently far apart to receive a non-uniform stack at the receiving position, and converge to engage the slices and form a substantially vertically aligned uniform stack as the stack moves toward the stack-formed position;

the moving means includes means for moving the first and second stack engaging members in an intermittent motion, stopping the first and second stack engaging members adjacent the receiving position for receiving the stack of sausage slices between each adjacent pair of the first and second stack engaging members; and the conveyor means being for moving the stack of sausage slices at a speed greater than the speed of the forwardmost stack engaging member and for urging the stack of sausage slices up to and against the forwardmost stack engaging member.

12. A method for forming a substantially aligned and uniform stack of flat articles which are in at least partial overlapping relationship, the method comprising:

positioning a non-uniform stack of flat articles between at least a pair of spaced stack engaging members which are longitudinally movable in the same direction between a receiving position for receiving a non-uniform stack and a stack-formed position;

moving the stack engaging members in the same longitudinal direction between the receiving position and the stack-formed position at sufficiently different speeds that the stack engaging members converge to engage and form the articles into substantial vertical alignment as the stack moves toward the stack-formed position; and positioning the stack on an underlying conveyor for continuously urging the stack in the same direction as the stack engaging members move, said urging step including moving the stack at a speed greater than that of the stack engaging members in order to urge the stack up to and against the forwardmost stack engaging members.

13. A method in accordance with claim 12, wherein the flat articles are sliced food products.

14. A method for forming a substantially aligned and uniform stack of flat articles which are in at least partial overlapping relationship, the method comprising;

positioning a non-uniform stack of flat articles between at least a pair of spaced stack engaging members which are longitudinally movable in the same direction between a receiving position for receiving a non-uniform stack and a stack-formed position;

moving the stack engaging members in the same longitudinal direction between the receiving position and the stack-formed position at sufficiently different speeds that the stack engaging members converge to engage and form the articles into substantial vertical alignment as the stack moves toward the stack-formed position;

positioning the stack on an underlying conveyor for continuously urging the stack in the same direction that the stack engaging members move, said urging step including moving the stack at a speed greater than the forwardmost stack engaging member in order to urge the stack up to and against the forwardmost stack engaging members; and compressing the stack laterally to aid in forming the substantially aligned and uniform stack.

15. A method for forming a substantially aligned and uniform stack of flat articles which are in at least partial overlapping relationship, the method comprising:

positioning a non-uniform stack of flat articles between at least a pair of spaced stack engaging members which are longitudinally movable in the same direction between a receiving position for receiving a non-uniform stack and a stack-formed position;

moving the stack engaging members in the same longitudinal direction between the receiving position and the stack-formed position at sufficiently different speeds that the stack engaging members converge to engage and form the articles into substantial vertical alignment as the stack moves toward the stack-formed position;

compressing the stack laterally to aid in forming the substantially aligned and uniform stack; and applying a downward containment force to the stack at substantially the same time as the stack is compressed laterally.

16. A method in accordance with claim 14, wherein said step of compressing is achieved by moving the stack between a pair of fixed side engaging members which are spaced apart slightly less than the normal width of a uniform stack.

17. A method in accordance with claim 12, wherein the stack engaging members are moved intermittently in the longitudinal direction.

18. A method in accordance with claim 15, wherein the downward containment force is applied by a roller positioned to engage the top of a stack as the stack moves to the stack-formed position.

19. A method for forming a substantially aligned and uniform stack of flat articles which are in at least partial overlapping relationship, the method comprising:

positioning a non-uniform stack of flat articles between at least a pair of spaced stack engaging members which are longitudinally movable in the same direction between a receiving position for receiving a non-uniform stack and a stack-formed position;

moving the stack engaging members in the same longitudinal direction between the receiving position and the stack-formed position at sufficiently different speeds that the stack engaging members converge to engage and form the articles into substantial vertical alignment as the stack moves toward the stack-formed position;

positioning the stack on an underlying conveyor for continuously urging the stack in the same direction as the stack engaging members, said urging step including moving the stack at a speed greater than that of the forwardmost stack engaging member in order to urge the stack up to and against the forwardmost stack engaging member; and moving the stack engaging members in an intermittent motion between the receiving and stack-formed positions.

* * * * *